US005257726A

United States Patent [19]

Graf et al.

[11] Patent Number: 5,257,726

[45] Date of Patent: * Nov. 2, 1993

[54] DISPENSER FOR FLOWABLE MEDIA

[75] Inventors: Lothar Graf, Worblingen; Karl-Heinz Fuchs, Radolfzell, both of Fed. Rep. of Germany

[73] Assignee: Ing. Erich Pfeiffer GmbH & Co. KG, Fed. Rep. of Germany

[ * ] Notice: The portion of the term of this patent subsequent to May 1, 2007 has been disclaimed.

[21] Appl. No.: 865,739

[22] Filed: Apr. 9, 1992

Related U.S. Application Data

[63] Continuation of Ser. No. 513,772, Apr. 24, 1990, abandoned, which is a continuation-in-part of Ser. No. 903,414, Sep. 3, 1986, Pat. No. 4,921,142.

[30] Foreign Application Priority Data

Aug. 14, 1985 [DE] Fed. Rep. of Germany ..... 3532890

[51] Int. Cl.[5] ..... B67D 5/64

[52] U.S. Cl. ..... 222/320; 222/386

[58] Field of Search ..... 222/319, 320, 321, 383, 222/386, 183, 162; 239/184, 309, 320, 329, 331, 333

[56] References Cited

U.S. PATENT DOCUMENTS

| | | | |
|---|---|---|---|
| 1,926,367 | 9/1933 | Booth | 222/320 |
| 1,948,054 | 2/1934 | Stringfellow | 222/320 |
| 2,550,210 | 4/1951 | Vance, Jr. | 222/320 |
| 2,915,225 | 12/1959 | Atkins | 222/320 |
| 3,254,803 | 6/1966 | Meshberg | 222/183 X |
| 3,411,503 | 11/1968 | Santomieri | 222/105 X |
| 3,878,973 | 4/1975 | Riccio | 222/319 |
| 4,175,704 | 11/1979 | Cohen | 222/320 X |
| 4,308,977 | 1/1982 | Sigmund et al. | 222/320 |
| 4,606,479 | 8/1986 | Van Brocklin | 222/321 |
| 4,609,129 | 9/1986 | Fisher | 222/319 X |
| 4,640,443 | 2/1987 | Corsette | 222/321 |
| 4,728,009 | 3/1988 | Schmidt | 239/333 |
| 4,801,093 | 1/1989 | Brunet et al. | 239/490 |
| 4,830,284 | 5/1989 | Merte | 239/333 |
| 4,921,142 | 5/1990 | Graf et al. | 222/320 X |
| 4,946,069 | 8/1990 | Fuchs | 222/43 |

FOREIGN PATENT DOCUMENTS

| | | | |
|---|---|---|---|
| 84088 | 12/1957 | Denmark | 222/320 |
| 632896 | 4/1927 | France | 222/320 |
| 2258164 | 8/1975 | France | 222/320 |
| 2504097 | 10/1982 | France | 222/402.13 |
| 191655 | 1/1923 | United Kingdom | 222/320 |

*Primary Examiner*—Kevin P. Shaver
*Attorney, Agent, or Firm*—Quarles & Brady

[57] ABSTRACT

A dispenser for flowable media is constructed as a disposable atomizer, whose entire media reservoir is formed by the pump chamber of a thrust piston pump. The freely exposed cylindrical container constructed as a push button-like handle is therefore valve-free and can only be opened towards the outlet duct.

20 Claims, 2 Drawing Sheets

DISPENSER FOR FLOWABLE MEDIA

CROSS REFERENCE TO RELATED APPLICATIONS

This is a continuation of U.S. application Ser. No. 513,722, filed on Apr. 24, 1990, now abandoned, which is a continuation-in-part of U.S. application Ser. No. 903,414, filed on Sept. 3, 1986, now U.S. Pat. No. 4,921,142.

BACKGROUND OF THE INVENTION

The invention relates to a dispenser for flowable media, particularly an atomizer, with a media reservoir located in a casing and with a thrust piston pump, which is provided with a pump piston displaceably guided on a piston path of a pump cylinder between a starting position and a pump stroke end position, as well as a pump chamber formed by the pump cylinder and connected to a discharge opening of the dispenser by means of an outlet duct, which is in the form of a dosing chamber determining the discharge volume for each complete pump stroke.

Known dispensers or delivery devices of this type have a media reservoir spatially separated from the pump chamber connected to said pump chamber by means of an inlet duct with a generally connected in intake valve and which feeds medium into the pump chamber during the pump piston return stroke. However, this makes such dispensers unsuitable for those applications in which, such as for a medical disposable syringe, only a single charge of an e.g. pharmaceutical medium is to be delivered and then the discharge device is, instead of being used again, thrown away, e.g. for hygienic, therapeutic or safety reasons.

SUMMARY OF THE INVENTION

An object of the present invention is to provide a dispenser for flowable media, particularly an atomizer, which is designed in such a way that it is suitable for a single use only, so that after use a minimum amount of residual medium is present therein and which can be manufactured particularly simply in view of the fact that it is only to be used once.

This object is achieved in the case of a dispenser of the aforementioned type in that the complete media reservoir thereof is formed by the closed pump chamber facing the pump piston and that the volume of said media reservoir approximately corresponds to a single discharge volume.

The pump cylinder surrounding the pump chamber is therefore tightly closed, except from the region in which the outlet duct is connected thereto or in which the pump piston is inserted, so that it can be manufactured as a very simple article made from plastic or the like. As the complete medium quantity stored in the dispenser is provided from the outset in the pump chamber or pump cylinder, it can be reliably ensured in a simple manner that the complete stored media quantity is discharged during a single pump stroke.

The inventive construction makes it possible to obviate the need for a cylinder casing with a separate cylinder cover, because the open end of the pump cylinder can be directly covered or closed by the main casing of the dispenser. Thus, as a freely accessible part, the pump cylinder can be directly mounted on the casing, which is e.g. open at the bottom and otherwise in one part, so that for performing the pump stroke it can be manually moved out of its starting position further over the pump piston and simultaneously acts in the manner of an operating push button. If the latter is in the starting position, i.e. prior to the single use of the dispenser completely within the casing, i.e. is appropriately set back at least slightly with respect to the open side of the casing, then it is readily accessible for said operation and also protected against accidental operation or other mechanical stresses. As the closed pump cylinder is only open towards the outlet duct, it does not return to its starting position following operation and instead remains in the pump stroke end position, so that it also, forms an indicator by means of which the use state of the dispenser can be clearly recognized. For easier recognition purposes, it is possible to provide a window cutout in the casing surface to make it possible to see the pump cylinder and this appropriately simultaneously constitutes a thumb contact opening for operating the dispenser.

The handle for securing the dispenser against the operating pressure and which faces the operating push button is appropriately formed by a finger shield for obtaining one-hand operation and this has oppositely projecting finger contact bases on either side adjacent to the central axis of the thrust piston pump, so that the index and middle fingers of the hand can be supported thereon, whilst the thumb rests on the push button. Thus, during operation, the dispenser can be very securely held and accurately guided, which is important e.g. when introducing corresponding pharmaceuticals into a nostril. As a result of the described construction, the dispenser can be kept very small, e.g. having a maximum extension of less than 5 cm.

According to a particularly advantageous further development of the invention, the cavities of the dispenser to be filled or flown through by the medium are appropriately sealed in air-tight manner to the outside and are appropriately filled up to the seal with the medium, i.e. without any air pockets. The seal can be formed by an outlet valve only opening in the case of an over pressure in the pump chamber and which is otherwise tightly closed and can be, in particular, a ball hose valve. However, it is also conceivable to seal in an air-tight manner the outlet duct or discharge opening by means of a seal which does not close again after opening and which is preferably constructed in such a way that on reaching a given overpressure on its side associated with the pump chamber, it opens e.g. accompanied by destruction or cracking. For example a diaphragm could constitute a seal representing a desired fracture element or which is held in the closed position by means of at least one desired fracture element.

In order that during the single pump stroke as far as possible the entire stored medium quantity is discharged, a displacement body is appropriately provided in the pump chamber which, in the pump stroke end position projects well into the outlet duct and preferably approximately up to the seal and keeps it almost completely filled except for the flow slots or cannulas.

BRIEF DESCRIPTION OF THE DRAWINGS

The invention is described in greater detail hereinafter relative to non-limitative embodiments and the attached drawings, wherein.

DETAILED DESCRIPTION OF THE PREFERRED EMBODIMENTS

Figure 1:
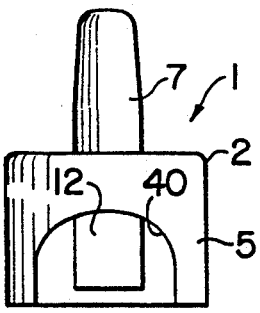
FIG. 1 shows a dispenser according to the invention in elevation and natural size.
Figure 2:
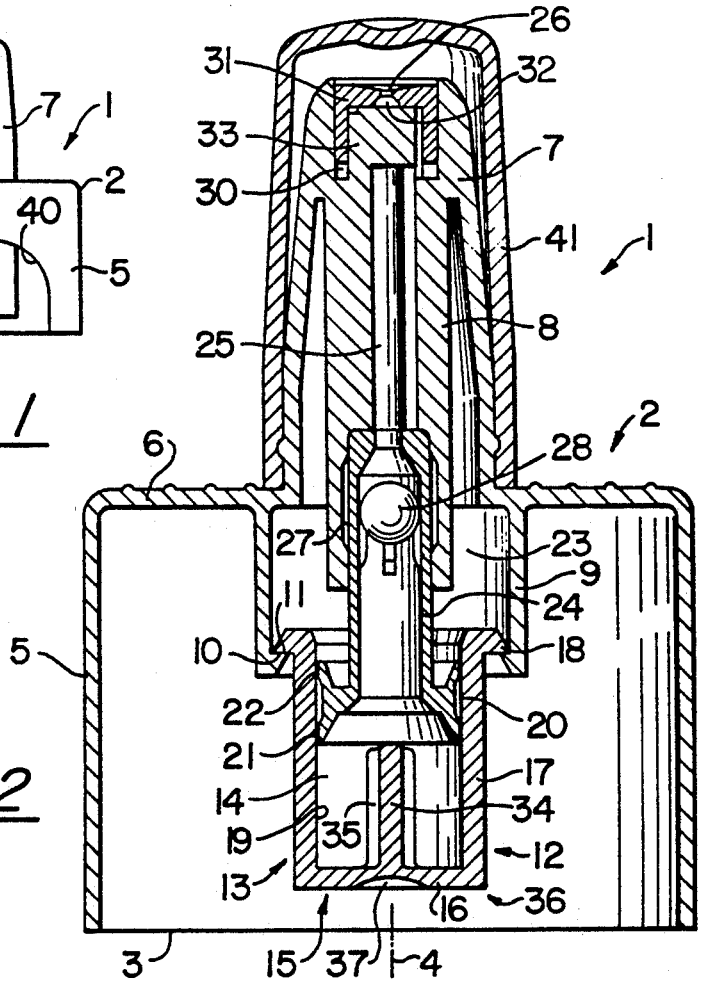
FIG. 2 shows the dispenser according to FIG. 1 in axial section and on a larger scale.
Figure 3:
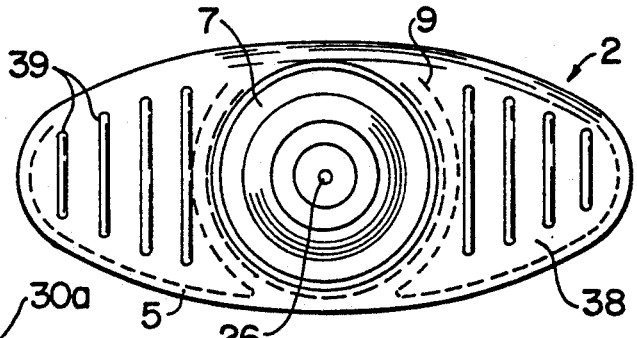
FIG. 3 shows a plan view of the dispenser according to FIG. 1, but with a cap removed.

The dispenser 1 according to FIGS. 1 to 3 has a casing 2, whose basic body is only open to one side in the manner of a cap and forms on this open face a base 3 located in one plane. Casing 2 is axially symmetrical to a central axis 4 or symmetrical to two axial planes at right angles to one another, but in the direction of one of these axial planes has a much greater extension than in the other axial plane. In the represented embodiment, the basic body of casing 2, which is essentially formed by casing surface 5 and end wall 6 facing the open side, is elliptical in an axial view, so that its outer faces are outwardly convexly curved with different radii of curvature.

A discharge connection 7 in central axis 4 and constructed in one piece with end wall 6 of casing 2 projects therefrom. Connection 7 is bounded in a circular manner in axial view and is set back over its entire outer circumference with respect to the outer faces of surface 5, i.e. has a smaller external diameter than the smallest diagonal dimension of the casing basic body. Towards its free end, discharge connection 7 is conically tapered in acute-angled manner and a projecting inner sleeve free from its free end over its entire length and which as a sleeve shoulder 8 projects into the casing basic body past the inner face of end wall 6, a substantially cylindrical inner sleeve 9 constructed in one piece therewith projects only over part of the height or length of the casing basic body, whose external diameter can be approximately the same as the smallest outer diagonal dimension of the said basic body, i.e. whose outer circumference passes in the vicinity of two diametrically facing zones into the casing surface 5 or is formed by the latter. It is also conceivable to form the inner sleeve 9 by two approximately semicylindrical shells, whose plane of division located in an axial plane of central axis 4 is located in the minimum diagonal dimension zone of the casing basic body and which optionally projects in contact-free manner into the casing interior with respect the inner face of casing surface 5. The inner sleeve 9 located in the central axis 4 is provided on its free end with a circular lug or stop cam 10 projecting over its inner circumference and which forms a substantially rectangular, circular inner shoulder 11 towards central axis 4. From the end remote from end wall 6, a cylindrical container 12 projects into inner sleeve 9 and which is constructed as a simple, cylindrical, cup-shaped container, which is only open at one end. Cylindrical container 12 forms the complete media reservoir 13 of dispenser 1 and surrounds a pump chamber 14, which is closed at its end opposite to the open end of cylindrical container 12 by a wall which is substantially at right angles to central axis 4. This end face 15 is closed by end wall 16, which is constructed in one piece with the approximately cylindrical surface 17 of cylindrical container 12. At the open end, the surface 17 is provided with an annular, uninterrupted spring-in flange 18 projecting over its outer circumference and which with the cylindrical container 17 inserted engages behind the inner shoulder 11 of inner sleeve 9 and abuts against the same, so that the cylindrical container 12 is accurately axially secured in its starting position. The inner circumference of cylindrical container 12 or surface 17 forms a piston path 19 for a pump piston 20, which has two oppositely acute-angled converging, axially succeeding piston lips 21, 22 for guiding on piston path 19. Pump piston 20 is constructed as a hollow pump piston, which is provided at the end of a hose portion 24 of a piston rod 23 constructed in one piece therewith, the other portion of piston rod 23 being formed by the sleeve shoulder 8. The end of hose portion 24 remote from pump piston 20 is secured in axially abutting manner in a widened bore portion of the associated free end of sleeve shoulder 8. Portion 24 and sleeve shoulder 8 form an outlet duct 25 located completely within the piston rod in central axis 4, which connects the pump chamber 14 with a discharge opening 26, which leads to the open, at the free end of discharge connection 7 and interposing an outlet valve 27. Outlet valve 27, which is provided in the area of hose portion 24 engaging in sleeve shoulder 8 and approximately in the same axial region as end wall 6, is constructed as a ball hose valve. The valve body 28 of said outlet valve 27 formed by a ball is tightly surrounded by the associated, elastically expandable longitudinal part of hose portion 24, said longitudinal part being located in the vicinity of a portion of the bore of sleeve shoulder 8 slightly widened with respect to its external diameter, which on either side of valve body 28 engages on the outer circumference of hose portion 24 and therefore supports the same on either side of valve body 28.

The surface of a cup-shaped nozzle cap 31 is placed in an annular groove 30 located in central axis 4 in the free end of discharge connection 7 and has in its free end wall set back slightly with respect to the end face of connection 7 an atomizer nozzle 32 forming discharge opening 26. Annular groove 30 forms a freely projecting mandrel 33, which largely engages on the inner face of the surface of nozzle cap 31, but has connecting channels for the medium leading from the remaining outlet duct 25 to the atomizer nozzle 32.

A displacement body 34 in the form of a displacement mandrel is provided on the inside of end wall 16 of cylindrical container 12, which is positioned in central axis 4 and projects in the direction counter to pump piston 20. The external diameter of the displacement body is only slightly smaller than the internal diameter of hose portion 24 and which has a plurality of circumferentially distributed longitudinal slots 35 extending over its entire length. In the starting position, the end face of displacement body 34 is approximately located in the plane of the terminal end face of pump piston 20 which faces it. The length of displacement body 34 approximately corresponds to the length of the maximum pump stroke. In the starting position, the pump piston 20 or its rear piston lip 22 is close to the rear end of the piston path 19, which passes into the open end face of cylindrical container 12 via a frustum-widened insertion end portion.

With its end associated with end wall 16, cylindrical container 12 forms, in the manner of a push button, a handle 36, for which purpose is provided in the outside of end wall 16 a spherically segmentally depressed thumb reception surface 37 for reliably supporting the thumb cupula of a hand. The outside of end wall 6 of casing 2 forms in each case one handle 38 on either side of discharge connection 7 on the long elliptical legs and this is used for supporting in each case two further fingers of the same hand, so that the handles 36, 38 form a grip for the simultaneous holding and operating of the dispenser 1 by means of a single hand. For the better supporting of the fingers, on the outside of end wall 6 are provided gripping profiles, e.g. in the form of parallel projecting ribs 39. In surface 5 of casing 2 and namely on one of its two wider sides, a cut out 40 is provided symmetrically to the associated axial plane of symmetry of casing 2 and extends with parallel side boundaries up to base 3, whose concavely curved transverse boundary is spaced from end face 6 and at the most approximately extends level with the free end face of inner sleeve 9. The width of the cutout 40 provided for engagement with the thumb is made so large, that the thumb simultaneously is guided on both lateral boundaries, so that casing 2 can be placed on the thumb in a substantially self-holding manner. When using the dispenser, the thumb presses the cylindrical container 12 until its associated end face engages with the inner face of end wall 6 of casing 2 on pump piston 20 and, accompanied by the opening of outlet valve 27, the medium is discharged in atomized manner through discharge opening 26. Discharge connection 7 is covered by a cap 41 which completely surrounds it and which is secured by means of a spring detent with respect to discharge connection 7 and engages by its free end face on the outer face of end wall 6. Prior to using the dispenser 1, said cap 41 is removed, but is not shown in FIGS. 1 and 3.

Figure 4:
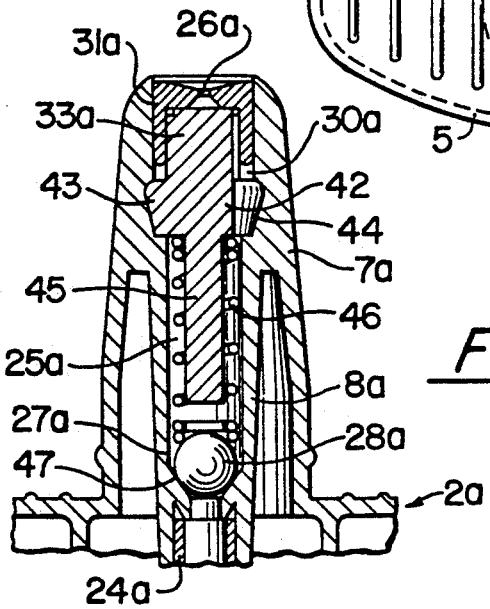
FIG. 4 shows another embodiment in a detail corresponding to FIG. 2.

In FIG. 4, corresponding parts are given the same reference numerals as in FIG. 2, but are followed by the letter a. In this case, mandrel 33*a* is formed by a separate component 42, which adjacent to the nozzle cap 31*a* is provided with a widened collar 43 which is flattened on one side. Collar 43 which is conically widened in acute-angled manner towards discharge opening 26*a* engages in an opening 44 in discharge connection 7*a*, which forms a portion of outlet duct 25*a* which is widened compared with the external diameter of annular groove 30*a* and is adapted to said collar. Accompanied by the elastic expansion of the discharge connection 7*a*, component 42 can be engaged from its free end in opening 44 in such a way that it is axially secured in clearance-free manner and held in centered form by a snap connection. At its end remote from mandrel 33*a*, following onto collar 43, component 42 has a guide mandrel 45, whose diameter is significantly smaller than the internal diameter of the associated portion of outlet duct 25*a* and which is surrounded by a valve spring 46 of outlet valve 27*a*. The latter has a valve body 28*a*, formed by a ball and movable axially counter to the spring tension of valve spring 46 in the open position and with which is associated as valve seat 47 an inner shoulder in sleeve flange 8*a*. Thus, unlike in the embodiment according to FIGS. 1 to 3, the outlet valve here is not a part of the piston unit and is instead part of the casing 2*a* or discharge connection 7*a*.

For filling the dispensers according to FIGS. 1 to 4, cylindrical container 12 is initially substantially completely filled with the medium to be dispensed, after which the pump piston 20 completely preassembled with casing 2 and outlet valve 27 is introduced into the open end of container 12. Cylindrical container 12 is engaged over the pump piston 20 until outlet valve 27 opens and consequently the enclosed air can escape to the outside. During this operation, the spring-in flange 18 slides with a frustum-shaped widening surface provided on its outer circumference on a corresponding, frustum-shaped counter-surface on the inner circumference of stop cam 18, so that the inner sleeve 9 is widened until flange engages behind inner shoulder 11.

As can be readily seen in FIGS. 2 and 3 means are provided for axially securing the pump cylinder with respect to the flat casing or basic body 2 in the initial position of the pump means only by direct engagement of the pump piston 20 into the pump cylinder, thereby providing holding and securing means only in the inside of the pump cylinder 17 in the vicinity of the open or free end thereof. The piston lips 21, 22 thereby provide angular securing flange members engaging an annular flange zone of the pump cylinder. By inserting the pump piston 20 into the pump cylinder 17 the securing members will be brought into engagement by a plug or snap connection.

A section of the dispenser provides a flat casing 5, 6 having cross-sections with largest cross-sectional extensions smaller in a first direction than in a transverse second direction, thereby according to FIG. 3 providing longitudinal end portions forming the handles 38 and a central portion receiving the central stud 7. The walls of this casing are at least partially or entirely substantially stiff or solid but slightly resiliently deformable walls. The casing having the flat jacket 5 provides the largest and radially most projecting one of all dispenser sections and the pump means is freely projecting into this casing in a substantially contact-free manner. The end wall 6 of the casing is penetrated in contact-free manner by shaft-like bearing member 8 exclusively bearing at least the pump piston 20 of the pump means in any pump position and connected to the dispenser body 2 only outside of the casing via an outer hollow stud portion connected to the end wall 6. The fluid container 12 also is a stiff or rigid-walled component. The flat casing 5, 6 is of substantially constant cross-section at least over a section connecting to the end wall 6 and the outer circumference of the end wall 6 is flush with the outer circumference of the casing jacket 5.

By providing one or two opposite flatter and broader jacket wall sections connected by smaller lateral wall sections a preferred depositing face is achieved for the dispenser and lying support of the dispenser on one of these depositing faces will lead to the most stable support of the dispenser needing the highest tilting momentum of all possible support positions for tipping the dispenser over into an other stable depositing position like a stand position on the end face 3. In this preferred lying position the handles 36, 38 and the at least one cutout 40 are freely accessible to be manually gripped in the same mode as for performing pump operation. If two opposite and substantially equal cutouts 40 are provided in both flat walls, in side elevation the dispenser has substantially the shape of a Y or T having end sections of the cross-bar directed way from the T-stem and these end sections provide substantially parallel and rigid legs for clamping user's thumb between them in such a way that the entire dispenser 1 can be supported by one single finger only via this clamping connection. The legs are V-shaped profiles. The cross-sectional length extension of the flat casing jacket is more than twice and less than three times as big as the transverse width extension and the length extension of the casing parallel to the central axis 4 is smaller than the larger cross-sectional width extension.

Figure 5:
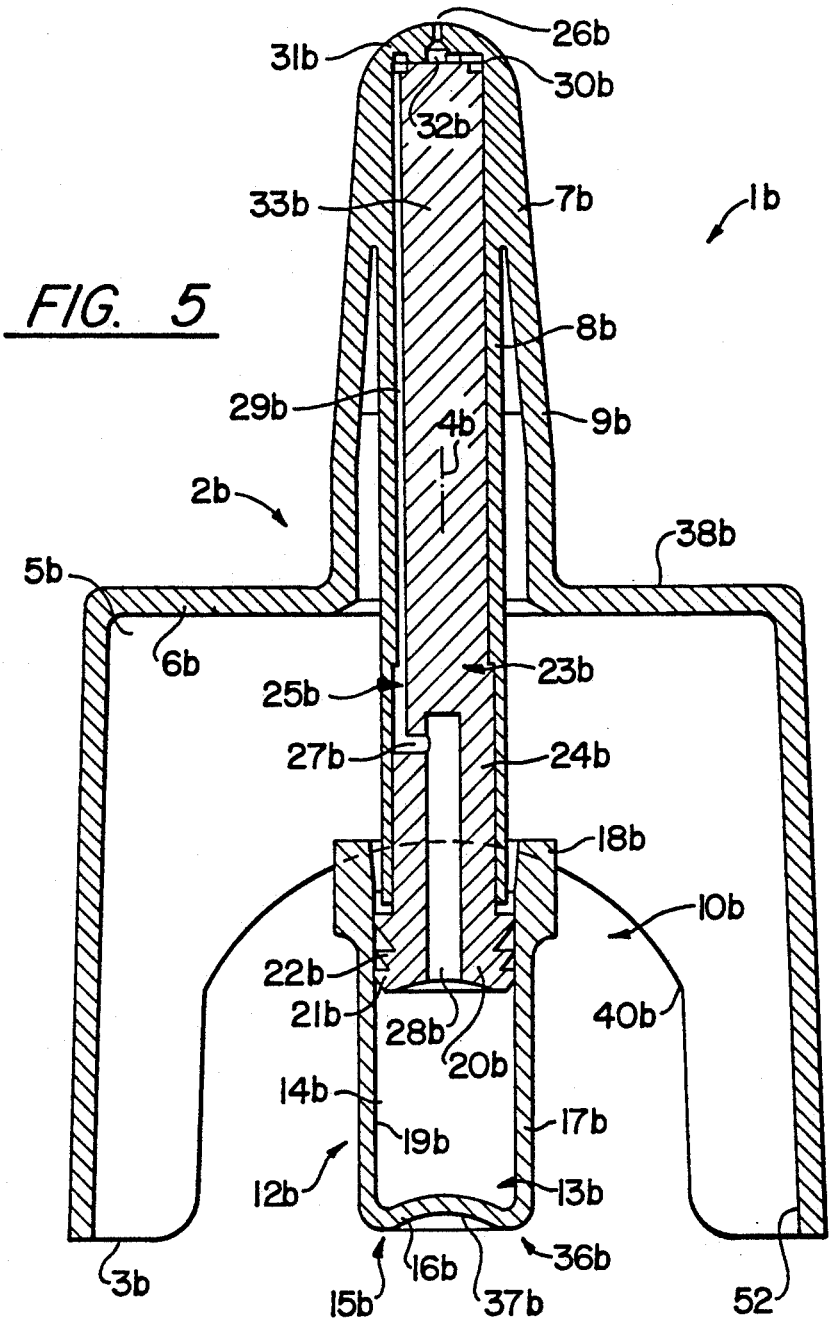
FIG. 5 shows a further embodiment of the dispenser in axial section similar to FIG. 2.
Figure 6:
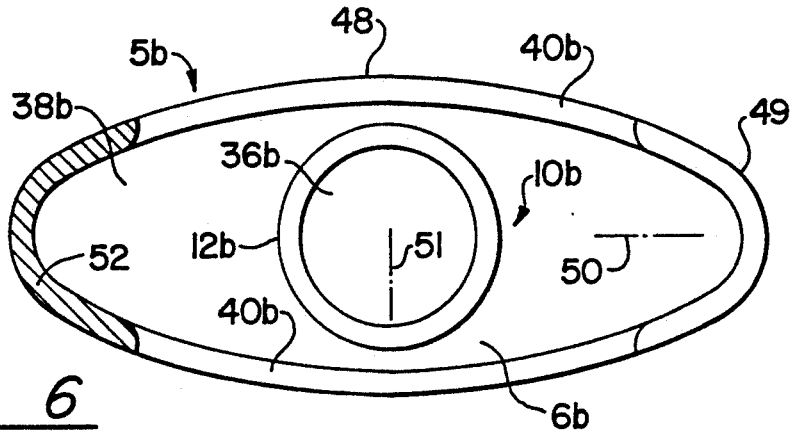
FIG. 6 shows a plan view of the bottom side of the dispenser according to FIG. 5.

Further features of the dispenser according to FIG. 1 to 6 will now be described by way of FIG. 5 and 6. In FIG. 5 and 6 corresponding parts are substantially given the same reference numerals as in FIG. 1 to 4 but are followed by the letter b and therefore the description of anyone of the figures is also a description of anyone of the other figures.

By way of FIG. 5 and 6 it will be understood that the pump cylinder **17*b* or container 12*b* is merely held by the inserted plug member provided by the pump piston 20*b*, an adjoining shaft portion 24*b* and eventionally a corresponding end portion of the tube-like inner sleeve 8*b* which might be very narrow to or even engage the inner circumference of the pump cylinder 17*b*. Pump piston 20*b* has three axially closely following piston lips 21*b*, 22*b* only separated by intermediate annular grooves providing a serrated configuration in cross-section. Front and rear piston lips 21*b* in cross-section do not have sharply pointed lip ends but are provided with a small cylindrical phase for higher frictional and guiding as well as resiliently preloaded engagement with the inner container circumference, thereby providing means for sufficiently axially securing the container 12*b* in the initial position to be overcome by an according high primary manual operating force. At least one intermediate piston lip 22*b*** also provided for tentioned engagement is sharply pointed in cross-section and has therefore a very good sealing effect. The axial extension of the single piston lip unit is smaller than the diameter thereof.

The pump piston **20*b* is a one-part component with the entire piston shaft 23*b* extending substantially up to the spray nozzle 32*b* or the inside of the end wall of the nozzle cap 31*b* which in this case is a one-part component with the stud 7*b*, the inner sleeve 8*b* and an outer sleeve 9*b* thereof. The outer sleeve 9*b* the outer circumference of the stud 7*b* adjoins with its rear end to the outside of the end wall 6*b* as a one-part component and does not project beyond the inside of this end wall 6*b*. The inner sleeve 8*b* and the outer sleeve 9*b* are only connected to each other as a one-part component outside of the casing 5*b* at a distance from the end wall 6*b*, thereby providing the nozzle cap 31*b*. From the front end of the outer sleeve 9*b* the inner sleeve 8*b* is freely projecting rewardly and circumferentially spaced from the inside of the outer sleeve 9*b* into the casing 5*b*, thereby penetrating the end wall 6*b* in contact-free manner. In a front section at a distance outside from end wall 6*b* the two sleeves 8*b*, 9*b* may be stiffend by circumferentially distributed substantially radial ribs. The front end of piston shaft 23*b* may be provided with profilings to contribute to a fluid stream propelling means 30*b* for better atomizing the fluid when entering the nozzle 32*b* and leaving the dispenser 1*b* via the discharge opening 26*b*. Such propelling means adapted for twisting the fluid stream around the nozzle axis can have an annular groove in either of the end face of the associated piston shaft portion 33*b* and the inner face of the end wall of nozzle cap 31*b*, radial or tangential grooves connecting this annular groove with the inner end of nozzle 32*b*. The piston shaft 23*b* has at least two longitudinally following shaft portions 24*b*, 33*b* slightly and stepwise reduced in diameter towards the front end and tightly received in an accordingly stepped bore of the inner sleeve 8*b***.

Only a first duct portion **28*b* of outlet duct 25*b* is circumferentially entirely bounded by the associated first shaft portion 24*b* and connected to the pump chamber 14*b* via the chamber bounding end face of the pump piston 20*b*. This duct portion 28*b* is provided by a blind bore connected to a following duct portion 29*b* by a radial or transverse duct 27*b* penetrating the outer circumference of the piston shaft 23*b* in the vicinity of shaft portion 24*b* and located close to the bottom face of duct portion 28*b*. Duct portion 29*b* uninterruptedly extending up to the propelling means 30*b* or the nozzle 32*b* is provided by a longitudinal slot or groove in the outer circumference of piston shaft 23*b* and bounded by the inner circumference of inner sleeve 8*b*. Transverse duct 27*b* is narrower than duct portion 28*b* and wider in cross-section than duct portion 29*b* which adjoining to transverse duct 27*b* first has a wider cross-section and then from the step between the shaft portion 24*b*, 33*b* onwards is accordingly reduced in its cross-section. Thereby an acceleration of the fluid will be achieved while flowing towards the nozzle 32*b***. Also a sufficient, labyrinth-like holding back of the fluid from leaving or entering the outlet duct before pump operation is secured without any valve or outlet valve.

In cross-section the casing **5*b* has a elliptical outer shape providing opposite and substantially flat wall sections 48 on both sides of an axial medium plane 50. The substantially rigid wall sections 48 are convexly curved on the outside or concavely on the inside by a radius of curvature which is bigger than the associated width extension in a direction parallel to an axial median plane 51 at right angles to plane 50. The corresponding widest inner width between the wall portions 48 is only slightly bigger than the external width of an outer open end and circumferentially projecting end flange 18*b* of the pump cylinder 17*b*, thereby providing only small gaps between this outer circumference and the inside of the wall sections 48. Wall sections 48 can resiliently be moved towards each other into contact with this outer circumference and will then be rigidly supported against further compression. Except for the pump means 10*b* the casing 5*b*** is entirely empty from any parts, installations or stiffening ribs.

Lateral regions of wall sections 48 are connected to each other by lateral edge or wall sections 49 convexly curved on the outside by a radius of curvature much smaller than the one of wall sections 48. The two opposite wall sections 49 on either side of median plane 51 have an up to 2.5 times bigger distance from each other than wall sections 48 and provide tilting or rolling edges unable to support the dispenser **1*b* in a free standing position. Because of the opposite cutouts 40*b* only provided in wall sections 48 two lateral freely and rearwardly substantially parallel extending legs 52 are provided by the dispenser casing 5*b*, the pump cylinder 17*b* not only being located entirely between imagined continuations of the wall sections 48 but also at a distance between the legs 52, thereby providing a third push button leg protected extending between the lateral legs 52. Each leg 52** is of a curved or substantially V-shaped profile in cross-section, the profile legs of both profiles being directed towards each other. By providing a substantially rigid flat jacket portion in a dispenser many benefits like better compactivness, resiliency, storaging and self-adjusting positioning can be achieved, whether this flat jacket is an external or an internal member of the dispenser.

We claim:

1. A manually operable fluid dispenser comprising:
a dispenser body;
a fluid pump means for pumping fluids supported by said dispenser body, said fluid pump means providing a pump chamber and an operating surface for operating said pump means between an initial pump position and a pump end stroke position, said dispenser body forming an outlet duct for connecting said pump chamber to an outlet port formed on said dispenser body;
wherein said dispenser body provides a substantially stiff-walled, flattened casing having a cross-section with a minor cross-sectional extension axis in a first direction smaller than a major cross-sectional extension axis in a second direction transverse to said first direction.

2. The dispenser according to claim 1, wherein said casing provides outermost dispenser boundaries of said dispenser.

3. The dispenser according to claim 1, wherein said fluid pump means includes a fluid container which at least partially defines the pump chamber and has a substantially cylindrical inner surface, said fluid container having an open container end, equal in area to said inner surface, said pump means including a pump piston, said fluid container being connected to said flattened casing by said pump piston piston closing said open container end.

4. The dispenser according to claim 1, wherein said flattened casing is substantially elliptical in crosssection.

5. The dispenser according to claim 1, wherein said flattened casing has two openings defined on opposing sides of said casing along said minor axis, said openings defining two freely projecting, substantially opposite, equal and parallel legs, said legs providing two profile sections and a common end face of said flattened casing.

6. The dispenser according to claim 1, wherein said dispenser body provides two axially aligned dispenser sections, a first of said dispenser sections being said flattened casing and a second of said dispenser sections being a discharge connection containing the outlet port and connected to said flat casing.

7. A dispenser according to claim 1, wherein said flat casing surrounds said pump means and provides a second operating surface for said pump means.

8. The dispenser according to claim 1, wherein said flattened casing has an end wall longitudinally extending in plan view and providing operating surface, said end wall providing end portions and a central portion, said end portions of said longitudinal end wall provide push buttons separated by an intermediate member projecting past said central portion.

9. The dispensing according to claim 1, wherein said flattened casing is resiliently deflectable at least in one of said first and second directions.

10. The dispenser according to claim 1, wherein said flattened casing is substantially oblong in cross-section.

11. The dispenser according to claim 1, wherein said casing provides a flattened casing jacket, said jacket providing a largest longitudinal extension of said dispenser for any of said pump positions.

12. The dispenser according to claim 11, wherein said jacket has axially opposite jacket ends and a chamber bottom of said pump chamber provides said operating surface for operating said pump means, said chamber bottom being surrounded transversely by said flattened casing in contact-free manner in any one of said pump positions, said chamber bottom being located between said jacket ends of said flattened casing in any one of said pump position.

13. The dispenser according to claim 1, wherein said jacket surrounds said fluid pump means and is spaced from said fluid pump means.

14. A manually operable fluid dispenser comprising:
a dispenser body;
a fluid pump means for pumping fluid supported by said dispenser body, said fluid pump means providing a pump chamber in at least one operating surface for operating said pump means between an initial pump position and a pump end stroke position, said dispenser body providing an outlet duct for connecting said pump chamber to an outlet port formed on said dispenser body, said dispenser body including a casing for surrounding said pump means, said casing being separated from said pump chamber, said pump means being connected to said dispenser body by a single shaft unit comprising a sleeve shoulder connected to said casing externally and extending into an interior of said casing and inwardly spaced from an inner perimeter of said casing.

15. The dispenser according to claim 14, wherein said pump means is a thrust piston pump, having a piston unit and a pump cylinder, said shaft unit supporting said piston unit, said piston unit bearing said pump cylinder held and movable guided with respect to said dispenser body through said shaft unit, said pump cylinder moving relative to said casing with circumferential motion clearance in any one of said pump positions.

16. The dispenser according to claim 13, wherein said pump cylinder is fixed to said dispenser body by sliding engagement between inner cylinder wall of said pump cylinder and at least one piston lip unit connected to the piston unit, said piston lip providing two axially spaced annular sealing lips at a front end of said pump piston.

17. The dispenser according to claim 15, wherein said sealing lips provide a plurality of sealing surfaces, at least one of said sealing lips being radially resiliently deformable for engaging said inner wall in a pre-tension manner.

18. A manually operable fluid dispenser comprising:
dispenser body;
fluid pump means for pumping fluid supported by said dispensers body, said fluid pump means providing a pump chamber and at least one operating surface of repeating said pump means between an initial pump position and a pump end stroke position, said dispenser body providing an outlet duct for connecting said pump chamber to an outlet port formed on said dispenser body;
a casing having at lest one substantially flattened outer lying surface defining a lying plane, said lying surface being defined by a minor axis in a first direction smaller than a major axis in a transverse second direction, said lying surface being generally parallel to said major axis and being laterally bounded by rolling edges provided on opposite sides of a medium plane of said laying surface, said lying surface and said rolling edges creating a stable lying position for said dispenser body; and
said casing providing one said operating surface spaced axially from an oppositely directed second operating surface of said pump means, said second operating surface being surrounded by said casing in said initial pump position.

19. A manually operable fluid dispenser comprising:

a dispenser body;

fluid pump for pumping fluid supported by said dispenser body, said fluid pump means provided a pump chamber and at least one operating surface for operating said pump means for between an initial pump position and a pump end position, said dispenser body providing an outlet duct for connecting said pump chamber to an outlet port;

wherein said outlet port is provided in a nozzle cap inserted into a discharge head of said dispenser body, said nozzle cap receiving a nozzle mandrel in an inner cap space, said nozzle mandrel being a separate part from said discharge heads and permanently engaging said discharge head separate from said nozzle cap;

wherein said nozzle mandrel is connected to said discharge head by an axially securing snap connection, said snap connection being axially spaced form said nozzle cap.

20. A manually operable fluid dispensers comprising:

a dispenser body;

a fluid pump means for pumping fluid supported by said dispenser body, said fluid pump means providing a pump chamber and at least one operating surface for operating said pump means for between an initial pump position and a pump end position, said dispenser body providing an outlet duct for connecting said pump chamber to an outlet port;

wherein said outlet port is provided in a nozzle cap inserted into a discharge head of said dispenser body, said nozzle cap receiving a nozzle mandrel in an inner cap space, said nozzle mandrel being a separate part from said discharge head and permanently engaging said discharge head separate from said nozzle cap;

wherein said nozzle mandrel is inserted into said discharge head from an end of the discharge head by means of a resilient radially expansion of said discharge head.

* * * * *